US011735090B2

(12) United States Patent
Zhao et al.

(10) Patent No.: US 11,735,090 B2
(45) Date of Patent: Aug. 22, 2023

(54) DISPLAY PANEL HAVING A VARIED MULTIPLEXING GATE SIGNAL VOLTAGE

(71) Applicants: Beijing BOE Optoelectronics Technology Co., Ltd., Beijing (CN); BOE Technology Group Co., Ltd., Beijing (CN)

(72) Inventors: Jing Zhao, Beijing (CN); Xiuyun Chen, Beijing (CN); Yehao Zhang, Beijing (CN); Dapeng Liang, Beijing (CN); Meng Shi, Beijing (CN); Yadong Huang, Beijing (CN); Zhenguo Xu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 71 days.

(21) Appl. No.: 17/424,519

(22) PCT Filed: Sep. 30, 2020

(86) PCT No.: PCT/CN2020/119314
§ 371 (c)(1),
(2) Date: Jul. 21, 2021

(87) PCT Pub. No.: WO2022/067642
PCT Pub. Date: Apr. 7, 2022

(65) Prior Publication Data
US 2022/0157219 A1 May 19, 2022

(51) Int. Cl.
*G09G 3/20* (2006.01)

(52) U.S. Cl.
CPC ..... *G09G 3/2003* (2013.01); *G09G 2310/027* (2013.01); *G09G 2310/0297* (2013.01); *G09G 2330/021* (2013.01)

(58) Field of Classification Search
CPC ..... G09G 3/2003
(Continued)

(56) References Cited

U.S. PATENT DOCUMENTS 9,721,491 B2 8/2017 Pai
10,056,052 B2 8/2018 Shin et al.
(Continued)

FOREIGN PATENT DOCUMENTS

CN 103226928 A 7/2013
CN 105469752 A 4/2016
(Continued)

*Primary Examiner* — Long D Pham
(74) *Attorney, Agent, or Firm* — Westman, Champlin & Koehler, P.A.

(57) ABSTRACT

A method of driving a display panel, a driving circuit of a display panel, and a display panel are disclosed. The display panel includes a multiplexing unit and a plurality of pixels arranged in an array of M rows and N columns, the multiplexing unit includes a plurality of thin film transistors, and each thin film transistor includes a gate electrode applied with a multiplexing unit gate signal. The method includes: acquiring a plurality of data signals for driving i-th row of pixels, where $1 \leq i \leq M$; generating multiplexing unit gate signals for respective thin film transistors of the multiplexing unit based on the plurality of data signals; and applying the multiplexing unit gate signals to gate electrodes of the respective thin film transistors, so that the respective thin film transistors are turned on or turned off. The multiplexing unit gate signals change according to changes of the plurality of data signals.

12 Claims, 4 Drawing Sheets

(58) Field of Classification Search
USPC ..... 345/204
See application file for complete search history.

(56) References Cited

U.S. PATENT DOCUMENTS

| | | | | |
|---|---|---|---|---|
| 10,255,871 | B2 | 4/2019 | Oh | |
| 2010/0033216 | A1 | 2/2010 | Roth et al. | |
| 2014/0267218 | A1 | 9/2014 | Pai | |
| 2016/0093260 | A1 | 3/2016 | Watsuda | |
| 2016/0189600 | A1 | 6/2016 | Shin et al. | |
| 2016/0189657 | A1 | 6/2016 | Oh | |
| 2018/0068615 | A1* | 3/2018 | Imai ..... | G09G 3/3677 |

FOREIGN PATENT DOCUMENTS

| | | | |
|---|---|---|---|
| CN | 105741717 | A | 7/2016 |
| CN | 105741735 | A | 7/2016 |

* cited by examiner

DISPLAY PANEL HAVING A VARIED MULTIPLEXING GATE SIGNAL VOLTAGE

CROSS-REFERENCE TO RELATED APPLICATION(S)

This application is a 371 National Stage application of International Application No. PCT/CN2020/119314, filed on 30 Sep. 2020, entitled "DRIVING CIRCUIT OF DISPLAY PANEL, METHOD OF DRIVING DISPLAY PANEL, AND DISPLAY PANEL", the contents of which are incorporated herein by reference in their entireties.

TECHNICAL FIELD

The present disclosure relates to a field of display technology, and in particular to a driving circuit of a display panel, a method of driving a display panel, and a display panel.

BACKGROUND

With a rapid development of display technology, people's demand for display screen is increasing. For example, display screen is more and more widely used in mobile office, audio and video playback, and other occasions. These occasions require a development of large-size display screen. The large-size display screen may display more content, and may display delicate video content at a high resolution.

SUMMARY

In one aspect, a method of driving a display panel is provided, wherein the display panel includes a multiplexing unit and a plurality of pixels arranged in an array of M rows and N columns, the multiplexing unit includes a plurality of thin film transistors, and each thin film transistor of the multiplexing unit includes a gate electrode applied with a multiplexing unit gate signal, a first electrode applied with a data signal, and a second electrode electrically connected to a pixel driving circuit of a pixel; and wherein the method includes: acquiring a plurality of data signals for driving i-th row of pixels, where $1 \leq i \leq M$; generating multiplexing unit gate signals for respective thin film transistors of the multiplexing unit based on the plurality of data signals; and applying the multiplexing unit gate signals to gate electrodes of the respective thin film transistors, so that the respective thin film transistors of the multiplexing unit are turned on or turned off, wherein the multiplexing unit gate signals change according to changes of the plurality of data signals.

According to some exemplary embodiments, the plurality of data signals for driving the i-th row of pixels include a plurality of positive voltage signals and a plurality of negative voltage signals, and the method further includes: determining a maximum positive voltage which has a maximum value among the plurality of positive voltage signals; and determining a minimum negative voltage which has a minimum absolute value among the plurality of negative voltage signals.

According to some exemplary embodiments, the generating the multiplexing unit gate signals for the respective thin film transistors of the multiplexing unit based on the plurality of data signals includes: determining a sum of the maximum positive voltage and a threshold voltage of the thin film transistor as a first turn-on voltage threshold in response to that the data signals are positive voltage signals; and generating the multiplexing unit gate signals which are greater than the first turn-on voltage threshold.

According to some exemplary embodiments, the generating the multiplexing unit gate signals for the respective thin film transistors of the multiplexing unit based on the plurality of data signals includes: in response to that the data signals are negative voltage signals, comparing a sum of the minimum negative voltage and the threshold voltage of the thin film transistor with zero and determining a greater one of the sum and zero as a second turn-on voltage threshold; and generating the multiplexing unit gate signals which are greater than the second turn-on voltage threshold.

According to some exemplary embodiments, the generating the multiplexing unit gate signals for the respective thin film transistors of the multiplexing unit based on the plurality of data signals includes: determining zero as a first turn-off voltage threshold in response to that the data signals are positive voltage signals; and generating the multiplexing unit gate signals which are smaller than the first turn-off voltage threshold.

According to some exemplary embodiments, the generating the multiplexing unit gate signals for the respective thin film transistors of the multiplexing unit based on the plurality of data signals includes: in response to that the data signals are negative voltage signal, comparing a sum of the minimum negative voltage and the threshold voltage of the thin film transistor with zero and determining a smaller one of the sum and zero as a second turn-off voltage threshold; and generating the multiplexing unit gate signals which are smaller than the second turn-off voltage threshold.

According to some exemplary embodiments, each pixel includes a first primary-color sub-pixel, a second primary-color sub-pixel and a third primary-color sub-pixel, and in the same frame, a plurality of data signals for driving a plurality of columns of sub-pixels with the same primary color have the same voltage polarity.

In another aspect, a driving circuit of a display panel is provided, wherein the display panel includes a multiplexing unit and a plurality of pixels arranged in an array of M rows and N columns, the multiplexing unit includes a plurality of thin film transistors, and each thin film transistor of the multiplexing unit includes a gate electrode applied with a multiplexing unit gate signal, a first electrode applied with a data signal, and a second electrode electrically connected to a pixel driving circuit of a pixel; and wherein the driving circuit includes: an acquisition circuit configured to acquire a plurality of data signals for driving i-th row of pixels, where $1 \leq i \leq M$; and a generation circuit configured to generate multiplexing unit gate signals for respective thin film transistors of the multiplexing unit based on the plurality of data signals; wherein the generation circuit is electrically connected to gate electrodes of the respective thin film transistors so as to apply the multiplexing unit gate signals to gate electrodes of the respective thin film transistors, so that the respective thin film transistors of the multiplexing unit are turned on or turned off; and wherein the multiplexing unit gate signals change according to changes of the plurality of data signals.

According to some exemplary embodiments, the driving circuit further includes a comparison circuit configured to: determine a maximum positive voltage which has a maximum value among the plurality of positive voltage signals; and determine a minimum negative voltage which has a minimum absolute value among the plurality of negative voltage signals.

According to some exemplary embodiments, the generation circuit is further configured to: determine a sum of the maximum positive voltage and a threshold voltage of the thin film transistor as a first turn-on voltage threshold, in response to that the data signals are positive voltage signals; and generate the multiplexing unit gate signals which are greater than the first turn-on voltage threshold.

According to some exemplary embodiments, the generation circuit is further configured to: in response to that the data signals are negative voltage signals, compare a sum of the minimum negative voltage and the threshold voltage of the thin film transistor with zero and determine a greater one of the sum and zero as a second turn-on voltage threshold; and generate the multiplexing unit gate signals which are greater than the second turn-on voltage threshold.

According to some exemplary embodiments, the generation circuit is further configured to: determine zero as a first turn-off voltage threshold in response to that the data signals are positive voltage signals; and generate the multiplexing unit gate signals which are smaller than the first turn-off voltage threshold.

According to some exemplary embodiments, the generation circuit is further configured to: in response to that the data signals are negative voltage signal, compare a sum of the minimum negative voltage and the threshold voltage of the thin film transistor with zero and determine a smaller one of the sum and zero as a second turn-off voltage threshold; and generate the multiplexing unit gate signals which are smaller than the second turn-off voltage threshold.

In yet another aspect, a display panel is provided, including the driving circuit as described above.

DETAILED DESCRIPTION OF EMBODIMENTS

Figure 1:
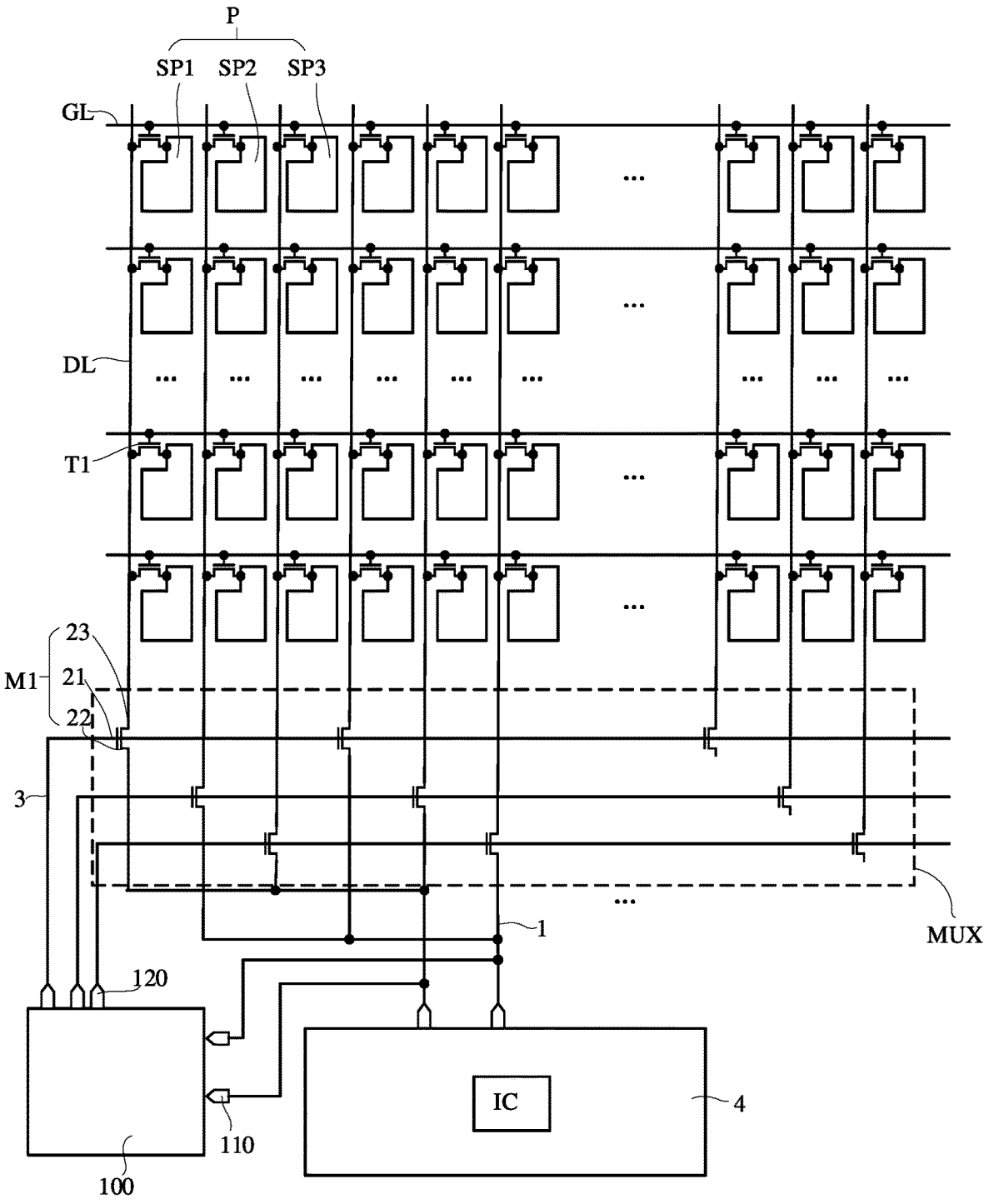
FIG. 1 shows a schematic diagram of a display panel according to some exemplary embodiments of the present disclosure, where a plurality of pixels, a multiplexing unit, and a driving circuit for the multiplexing unit are schematically shown.

In order to make objectives, technical solutions and advantages of the present disclosure more apparent, specific implementations of a pixel driving circuit, a driving method thereof, a display panel and a display device provided by the embodiments of the present disclosure will be described in detail below with reference to the drawings. It should be understood that the embodiments described below are only used to illustrate and explain the present disclosure, but not to limit the present disclosure. It should be noted that, in the case of no conflict, the embodiments in the present disclosure and the features in the embodiments may be combined with each other. It should be noted that a size and a shape of each figure in the drawings do not reflect an actual ratio, and a purpose is only to illustrate the present disclosure. In addition, the same or similar reference numerals indicate the same or similar elements or elements having the same or similar functions throughout.

The embodiments of the present disclosure provide a method of driving a display panel. The display panel includes a multiplexing unit and a plurality of pixels arranged in an array of M rows and N columns. The multiplexing unit includes a plurality of thin film transistors, each thin film transistor including a gate electrode applied with a multiplexing unit gate signal, a first electrode applied with a data signal, and a second electrode electrically connected to a pixel driving circuit of a pixel. The method includes: acquiring a plurality of data signals for driving i-th row of pixels, where $1 \leq i \leq M$; generating multiplexing unit gate signals for respective thin film transistors of the multiplexing unit based on the plurality of data signals; and applying the multiplexing unit gate signals to gate electrodes of the respective thin film transistors, so that the respective thin film transistors of the multiplexing unit are turned on or turned off. The multiplexing unit gate signals change according to changes of the plurality of data signals.

In the embodiments of the present disclosure, a control voltage (that is, a gate voltage) for the multiplexing unit is not a fixed voltage, which avoids a redundant waste of power consumption due to a fixed control voltage, so that an amplitude of the control voltage (that is, the gate voltage) for the multiplexing unit is reduced, and an overall power consumption of the display panel is reduced.

During a display process of a display device, the driving circuit outputs signals to scan pixels row by row. As a resolution of the display device increases, the number of pixels is increasing, and a data chip needs to output pixel voltages to pixel units through a plurality of data transmission lines. In order to reduce the number of data transmission lines, a multiplexing unit (that is, MUX unit) is provided between the data chip and respective data transmission lines.

In a source driving circuit provided with the multiplexing unit, gating of respective thin film transistors in the multiplexing unit is controlled by a multiplexing unit gate line (that is, MUX control line), so that the respective data transmission lines may be connected to a plurality of sub-pixel units through the multiplexing unit, and the number of data transmission lines is reduced. Each multiplexing unit gate line is a signal input terminal of the multiplexing unit, which is used for a gate control of the circuit, and which has a function similar to a switch.

FIG. 1 shows a schematic diagram of a display panel according to some exemplary embodiments of the present disclosure, where a plurality of pixels, a multiplexing unit and a driving circuit for the multiplexing unit are schematically shown. As shown in FIG. 1, the display panel may include a plurality of pixels P, a multiplexing unit MUX, and a driving circuit 100 for the multiplexing unit MUX.

The plurality of pixels P may be arranged in an array of M rows and N columns. For example, each pixel P includes a first primary-color sub-pixel SP1, a second primary-color sub-pixel SP2, and a third primary-color sub-pixel SP3. Exemplarily, the first primary-color sub-pixel SP1, the second primary-color sub-pixel SP2 and the third primary-color sub-pixel SP3 may be a red sub-pixel, a green sub-pixel and a blue sub-pixel, respectively. In a row direction, the first primary-color sub-pixel SP1, the second primary-color sub-pixel SP2 and the third primary-color sub-pixel SP3 are alternately arranged. In a column direction, the sub-pixels with the same primary color are located in the same column.

The display panel may include a plurality of gate lines GL and a plurality of data lines DL. Each sub-pixel may include a pixel driving circuit. As shown in FIG. 1, the pixel driving circuit may include at least one thin film transistor T1. It should be understood that the pixel driving circuit may further include other electronic components, such as a storage capacitor and the like. The thin film transistor T1 includes a gate electrode that may be electrically connected to the gate line GL, a source electrode that may be electrically connected to the data line DL, and a drain electrode that may be electrically connected to an electrode of the sub-pixel (for example, a pixel electrode). Under the control of a signal transmitted by the gate line GL, the data line DL may selectively charge the corresponding sub-pixel.

It should be noted that the number of sub-pixels and the arrangement of sub-pixels described above are only exemplary, mainly for the convenience of describing a specific technical concept of the embodiments of the present disclosure. The embodiments of the present disclosure are not limited thereto.

The display device may further include a main board provided with a data driver IC. The data driver IC is electrically connected to the driving circuit 100, and the driving circuit 100 is electrically connected to the multiplexing unit MUX. The main board 4 may be, for example, a printed circuit board (PCB or FPC), which may be used to provide data signals to the driving circuit 100 and the multiplexing unit MUX.

The data driver IC is electrically connected to the multiplexing unit MUX through a plurality of data transmission lines 1, and the multiplexing unit MUX is electrically connected to the pixel driving circuits through a plurality of data lines DL. In the embodiments shown in FIG. 1, a data transmission line 1 of the data driver IC is electrically connected to three data lines DL through the multiplexing unit MUX. That is to say, the data signal transmitted over the data transmission line 1 is supplied to three columns of sub-pixels. Such an implementation may be referred to as a 1:3 MUX scheme. It should be noted that the embodiments of the present disclosure are not limited thereto. In other embodiments, the data signal transmitted over the data transmission line 1 is supplied to six columns of sub-pixels, that is, a 1:6 MUX scheme is adopted. In this way, the number of data transmission lines may be greatly reduced, a size of a data driving chip may be reduced, and a size of a display frame may be reduced.

Continuing to refer to FIG. 1, the multiplexing unit MUX may include a plurality of thin film transistors M1, and each thin film transistor M1 includes a gate electrode 21, a first electrode 22 and a second electrode 23. The first electrode 22 may be one of a source electrode and a drain electrode, and the second electrode 23 may be the other of the source electrode and the drain electrode. The first electrode 22 of the thin film transistor M1 is electrically connected to the data transmission line 1, that is, it is applied with the data signal from the data driver IC. The second electrode 23 is electrically connected to the pixel driving circuit so as to transmit the data signal to each sub-pixel. The gate electrode is electrically connected to a multiplexing unit gate line 3, that is, it is applied with a multiplexing unit gate signal. Under the control of the multiplexing unit gate signal, turn-on or turn-off of the multiplexing unit MUX may be controlled, so that the data signals from the data driver IC are selectively distributed to respective columns of sub-pixels.

For example, the plurality of thin film transistors M1 may correspond to a plurality of columns of sub-pixels one-to-one. That is to say, N thin film transistors M1 may be provided, and each thin film transistor M1 corresponds to one column of sub-pixels. Every three thin film transistors may form a group, and the three thin film transistors correspond to three columns of sub-pixels with different primary colors. A group of thin film transistors M1 may be electrically connected to the same data transmission line 1.

In the embodiments of the present disclosure, the driving circuit 100 includes an input terminal 110 and an output terminal 120. The input terminal 110 is electrically connected to the plurality of data transmission lines 1 so as to receive a plurality of data signals from the data driver IC. The output terminal 120 is electrically connected to the plurality of multiplexing unit gate lines 3 so as to apply a plurality of multiplexing unit gate signals to the plurality of multiplexing unit gate lines 3.

Figure 2:
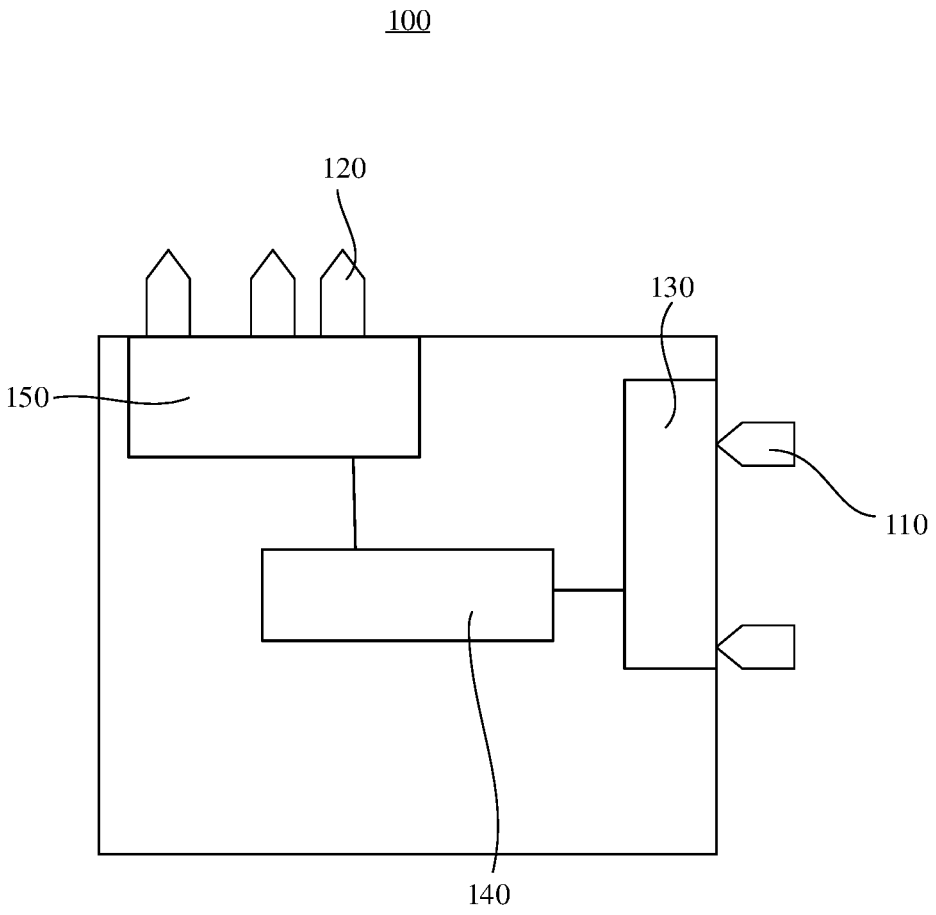
FIG. 2 shows a hardware block diagram of a driving circuit according to some exemplary embodiments of the present disclosure.

FIG. 2 shows a hardware block diagram of a driving circuit according to some exemplary embodiments of the present disclosure. Referring to FIG. 1 and FIG. 2 in combination, the driving circuit 100 may include an acquisition circuit 130, a comparison circuit 140 and a generation circuit 150.

The acquisition circuit 130 is configured to acquire a plurality of data signals for driving i-th row of pixels, where $1 \leq i \leq M$. The generation circuit 150 is configured to generate multiplexing unit gate signals for the respective thin film transistors M1 of the multiplexing unit MUX based on the plurality of data signals. The output terminal 120 is electrically connected to the plurality of multiplexing unit gate lines 3. The generation circuit 150 may apply the generated multiplexing unit gate signals to gate electrodes of the respective thin film transistors M1, so that the respective thin film transistors of the multiplexing unit are turned on or turned off.

In the embodiments of the present disclosure, the multiplexing unit gate signals generated by the generation circuit 150 change according to changes of the plurality of data signals. That is to say, each of gate signals for the respective thin film transistors M1 in the multiplexing unit MUX is not a fixed voltage (for example, ±8V), but dynamically changes according to a change of the data signal.

In the embodiments of the present disclosure, the control voltage (that is, the gate voltage) for the multiplexing unit is not a fixed voltage, which avoids a redundant waste of power consumption due to a fixed control voltage, so that an amplitude of the control voltage (that is, the gate voltage) for the multiplexing unit is reduced, and an overall power consumption of the display panel is reduced.

In some embodiments, the comparison circuit 140 is configured to determine a maximum positive voltage which has a maximum value among a plurality of positive voltage signals, and determine a minimum negative voltage which has a minimum absolute value among the plurality of negative voltage signals.

Optionally, the generation circuit is configured to, in response to that the data signals are positive voltage signals, determine a sum of the maximum positive voltage and a threshold voltage of the thin film transistor as a first turn-on voltage threshold and generate the multiplexing unit gate signals which are greater than the first turn-on voltage threshold.

Optionally, the generation circuit is configured to, in response to that the data signals are negative voltage signals, compare a sum of the minimum negative voltage and the threshold voltage of the thin film transistor with zero, determine a greater one of the sum and zero as a second turn-on voltage threshold, and generate the multiplexing unit gate signals which are greater than the second turn-on voltage threshold.

Optionally, the generation circuit is configured to determine zero as a first turn-off voltage threshold in response to that the data signals are positive voltage signals, and generate the multiplexing unit gate signals which are smaller than the first turn-off voltage threshold.

Optionally, the generation circuit is configured to, in response to that the data signals are negative voltage signals, compare a sum of the minimum negative voltage and a threshold voltage of the thin film transistor with zero, determine a smaller one of the sum and zero as a second turn-off voltage threshold, and generate the multiplexing unit gate signals which are smaller than the second turn-off voltage threshold.

Figure 3:
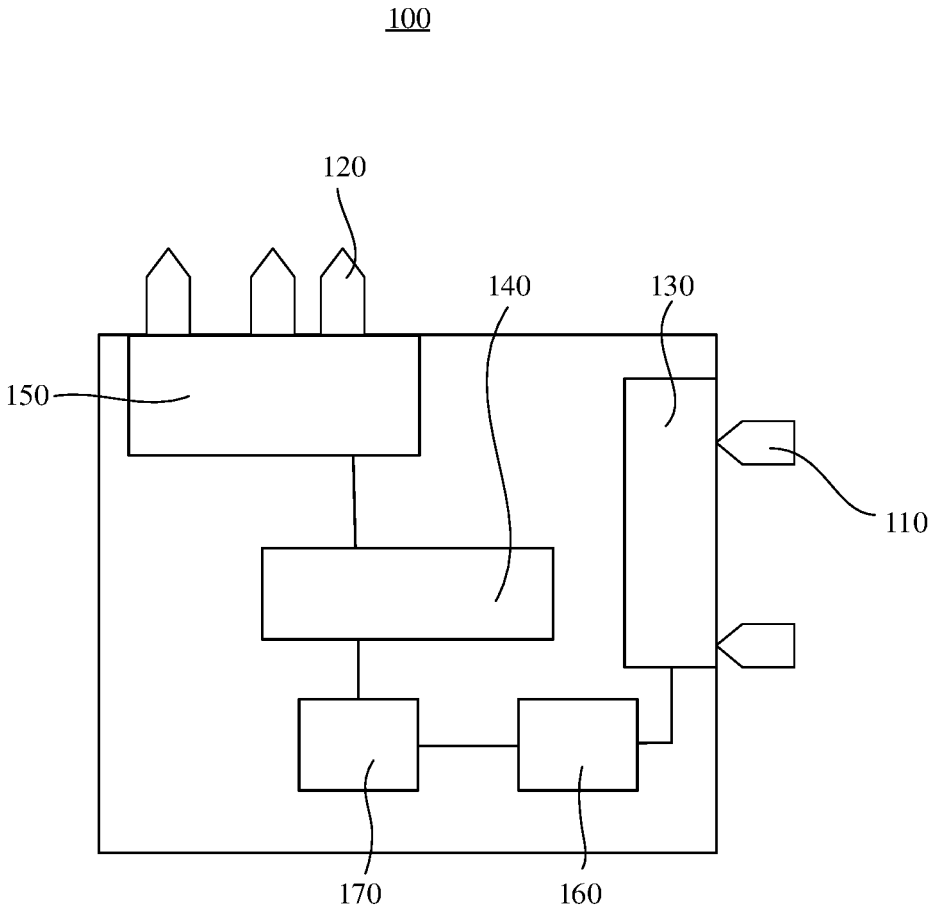
FIG. 3 schematically shows a specific implementation of a hardware block diagram of a driving circuit according to some exemplary embodiments of the present disclosure.

FIG. 3 shows a hardware block diagram of a driving circuit according to some exemplary embodiments of the present disclosure. In addition to the acquisition circuit 130, the comparison circuit 140 and the generation circuit 150, the driving circuit 100 may further include a register circuit 160 and a counting circuit 170.

For the plurality of positive voltage signals, an initial value in the register circuit 160 may be set to B=0. If A>0 in the comparison circuit 140, then B is assigned to A, and so on. Finally, the value B in the register circuit is assigned to the maximum positive voltage. Similarly, for the plurality of negative voltage signals, if A<B, B is assigned to A, and so on. Finally, the value B in the register circuit is assigned to the minimum negative voltage.

Figure 4:
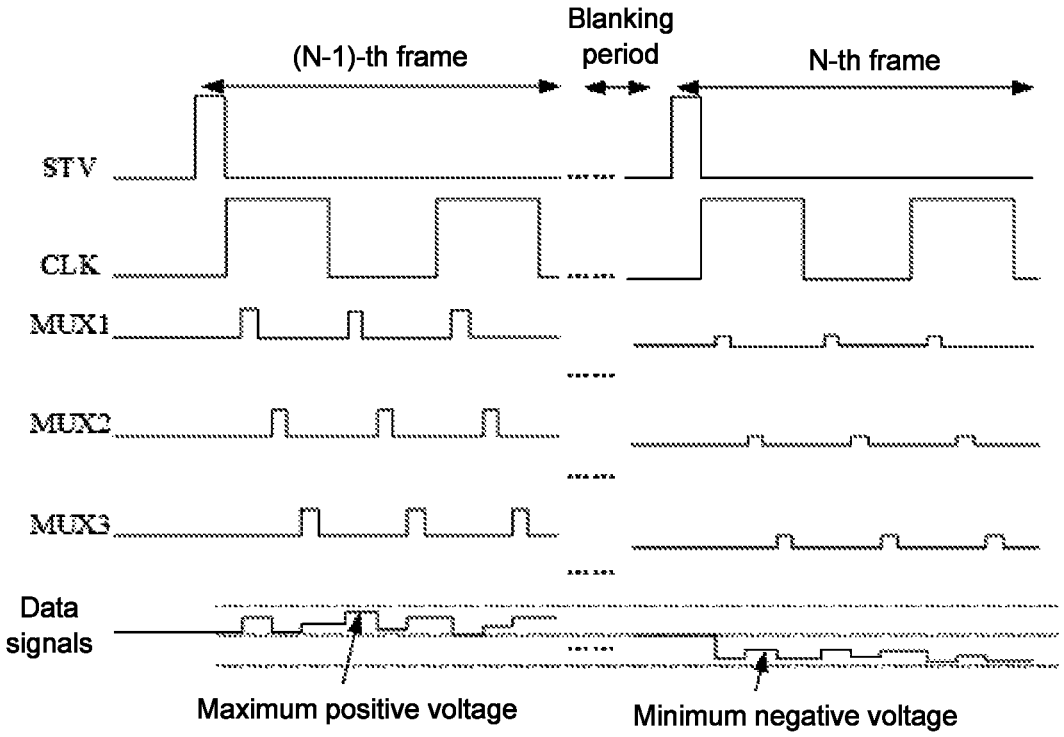
FIG. 4 shows a circuit timing diagram of a display panel according to the embodiments of the present disclosure.

A working process of the display panel including the driving circuit 100 shown in FIG. 1 will be schematically described. FIG. 4 shows a circuit timing diagram of the display panel according to the embodiments of the present disclosure.

Referring to FIG. 1 to FIG. 4 in combination, a turn-on signal STV is input to turn on a sub-pixel charging process. During the sub-pixel charging process, the gate lines GL are turned on row by row. The display panel has the same working process after each row of gate line GL is turned on. Therefore, the working process of the display device after the i-th row of gate line GL is turned on is illustrated here by way of example.

As shown in FIG. 4, after the i-th row of gate line GL is turned on, the data driver IC outputs 3*N data signals. Here, 3*N represents the number of sub-pixels in each row.

It should be noted that for a liquid crystal display panel, voltage polarities at both ends of a liquid crystal layer shall be inverted every predetermined time so as to avoid polarization of a liquid crystal material and a permanent damage. For example, the polarities of the pixel array may be inverted in four ways, including a frame inversion, a column inversion, a row inversion and a dot inversion. In the frame inversion, after an end of a previous frame writing and before a beginning of a next frame writing, voltages ΔV (ΔV=pixel voltage $V_{pixel}$-common voltage $V_{com}$) stored by the pixels in the entire frame have the same polarity (all positive or all negative). In the column inversion, voltages stored by the same column of pixels have the same polarity, and voltages stored by adjacent columns of pixels have opposite polarities. In the row inversion, voltages stored by the same row of pixels have the same polarity, and voltages stored by adjacent rows of pixels have opposite polarities. In the dot inversion, a voltage stored by each pixel has a polarity opposite to that of a voltage stored by any adjacent pixel. In the embodiments shown, the column inversion is illustrated by way of example, but the embodiments of the present disclosure are not limited thereto.

In the embodiments of the present disclosure, the pixel inversion mode is designed in order to balance the need for pixel inversion and the need for the gate signals of the multiplexing unit changing with the data signals.

In the same frame, voltages of a plurality of data signals for driving a plurality of columns of sub-pixels with the same primary color have the same polarity. For example, as shown in FIG. 1, in the same frame, voltages of a plurality of data signals for driving a plurality of columns of red sub-pixels have the same polarity, for example, they are all positive voltages; and voltages of a plurality of data signals for driving a plurality of columns of green sub-pixels have the same polarity, for example, they are all negative voltages.

The acquisition circuit of the driving circuit 100 may acquire the 3*N data signals. Then, the 3*N data signals may be divided into positive voltage signals and negative voltage signals according to the polarities of voltages. For example, the 3*N data signals may include 0.5*3*N positive voltage signals and 0.5*3*N negative voltage signals.

In the driving method, the maximum value of the plurality of positive voltage signals may be determined, and the voltage signal which has the maximum value among the plurality of positive voltage signals may be determined as the maximum positive voltage, and the minimum value of the absolute values of the plurality of negative voltage signals may be determined, and the voltage signal which has the minimum absolute value among the plurality of negative voltage signals may be determined as the minimum negative voltage.

Next, the generation circuit of the driving circuit 100 may generate the multiplexing unit gate signals for the respective thin film transistors of the multiplexing unit based on the 3*N data signals.

For example, the generating the multiplexing unit gate signals for the respective thin film transistors of the multiplexing unit based on the plurality of data signals may include: determining a sum of the maximum positive voltage and a threshold voltage of the thin film transistor as a first turn-on voltage threshold in response to that the data signals are positive voltage signals, and generating the multiplexing unit gate signals which are greater than the first turn-on voltage threshold.

Optionally, the generating the multiplexing unit gate signals for the respective thin film transistors of the multiplexing unit based on the plurality of data signals may include: in response to that the data signals are negative voltage signal, comparing a sum of the minimum negative voltage and the threshold voltage of the thin film transistor with zero and determining a greater one of the sum and zero as a second turn-on voltage threshold, and generating the multiplexing unit gate signals which are greater than the second turn-on voltage threshold.

Optionally, the generating the multiplexing unit gate signals for the respective thin film transistors of the multiplexing unit based on the plurality of data signals may include: determining zero as a first turn-off voltage threshold in response to that the data signals are positive voltage signals, and generating the multiplexing unit gate signal which are smaller than the first turn-off voltage threshold.

Optionally, the generating the multiplexing unit gate signals for the respective thin film transistors of the multiplexing unit based on the plurality of data signals may include: in response to that the data signals are negative voltage signal, comparing the sum of the minimum negative voltage and the threshold voltage of the thin film transistor with zero and determining a smaller one of the sum and zero as a second turn-off voltage threshold, and generating the multiplexing unit gate signals which are smaller than the second turn-off voltage threshold.

The above process will be described below by a specific implementation.

In this implementation, the threshold voltage Vth of the thin film transistor M1 is in a range of 1.3~1.5V, for example, about 1.5V. The plurality of data signals fluctuate within a range of ±5.7V and change according to an actual gray scale of a picture to be displayed.

For the 0.5*3*N positive voltage signals, in order to ensure that the corresponding thin film transistor M1 is turned on, the gate signal for the thin film transistor M1 shall meet the requirements of $Vg-Vs>Vth$, $Vg>0$, and $0\leq Vs\leq 5.7$, where Vg represents the gate voltage of the thin film transistor M1, and Vs represents the maximum value of the 0.5*3*N positive voltage signals, that is, the maximum positive voltage. According to the above requirements, it may be obtained $Vg>Vs+Vth$.

In order to ensure that the corresponding thin film transistor M1 is turned off, the gate signal for the thin film transistor M1 shall meet the requirements of $Vg-Vs<Vth$, $Vg<0$, and $0\leq Vs\leq 5.7$. According to the above requirements, it may be obtained $Vg<0$.

In other words, for the 0.5*3*N positive voltage signals, when $Vg>Vs+Vth$, it may be ensured that the thin film transistor M1 is turned on, and when $Vg<0$, it may be ensured that the thin film transistor M1 is turned off.

For the 0.5*3*N negative voltage signals, in order to ensure that the corresponding thin film transistor M1 is turned on, the gate signal for the thin film transistor M1 shall meet the requirements of $Vg-Vs>Vth$, $Vg>0$, and $-5.7\leq Vs\leq 0$, where Vg represents the gate voltage of the thin film transistor M1, and Vs represents the negative voltage signal with the smallest absolute value of the 0.5*3*N negative voltage signals, that is, the minimum negative voltage. According to the above requirements, it may be obtained $Vg>\max\{Vs+Vth, 0\}$.

In order to ensure that the corresponding thin film transistor M1 is turned off, the gate signal for the thin film transistor M1 shall meet the requirements of $Vg-Vs<Vth$, $Vg<0$, and $-5.7\leq Vs\leq 0$. According to the above requirements, it may be obtained $Vg<\min\{Vs+Vth, 0\}$.

In other words, for the 0.5*3*N negative voltage signals, when $Vg>\max\{Vs+Vth, 0\}$, it may be ensured that the thin film transistor M1 is turned on, and when $Vg<\min\{Vs+Vth, 0\}$, it may be ensured that the thin film transistor M1 is turned off.

Subsequently, the multiplexing unit gate signals generated by the generation circuit are applied to the respective thin film transistors M1. Under the control of the multiplexing unit gate signals, the respective thin film transistors M1 are turned on or turned off. When the thin film transistor M1 is turned on, the sub-pixels may be charged. When the thin film transistor M1 is turned off, the charging of the sub-pixel may be stopped.

Some embodiments of the present disclosure further provide a display device. The driving circuit 100 described above may be applied to the display device. For example, the display device may include a mobile phone, a desktop computer, a television, a tablet computer, a personal digital assistant (PDA), a vehicle-mounted computer, and the like. The embodiments of the present application do not impose special limits on the specific form of the display device.

Obviously, those skilled in the art may make various modifications and variations to the present disclosure without departing from the spirit and scope of the present disclosure. In this way, if these modifications and variations of the present disclosure fall within the scope of the claims of the present disclosure and their equivalent technologies, the present disclosure is also intended to include these modifications and variations.

What is claimed is:

1. A method of driving a display panel, wherein the display panel comprises a multiplexing unit and a plurality of pixels arranged in an array of M rows and N columns, the multiplexing unit comprises a plurality of thin film transistors, and each thin film transistor of the multiplexing unit comprises a gate electrode applied with a multiplexing unit gate signal, a first electrode applied with a data signal, and a second electrode electrically connected to a pixel driving circuit of a pixel; and wherein the method comprises:

acquiring a plurality of data signals for driving i-th row of pixels, where $1\leq i\leq M$;

generating multiplexing unit gate signals for respective thin film transistors of the multiplexing unit based on the plurality of data signals; and applying the multiplexing unit gate signals to gate electrodes of the respective thin film transistors, so that the respective thin film transistors of the multiplexing unit are turned on or turned off, wherein the multiplexing unit gate signals change according to changes of the plurality of data signals; and wherein the plurality of data signals for driving the i-th row of pixels comprise a plurality of positive voltage signals and a plurality of negative voltage signals, and the method further comprises:

determining a maximum positive voltage which has a maximum value among the plurality of positive voltage signals; and determining a minimum negative voltage which has a minimum absolute value among the plurality of negative voltage signals.

2. The method of claim 1, wherein the generating the multiplexing unit gate signals for the respective thin film transistors of the multiplexing unit based on the plurality of data signals comprises:

determining a sum of the maximum positive voltage and a threshold voltage of the thin film transistor as a first turn-on voltage threshold, in response to that the data signals are positive voltage signals; and generating the multiplexing unit gate signals which are greater than the first turn-on voltage threshold.

3. The method of claim 1, wherein the generating the multiplexing unit gate signals for the respective thin film transistors of the multiplexing unit based on the plurality of data signals comprises:

in response to that the data signals are negative voltage signals, comparing a sum of the minimum negative voltage and a threshold voltage of the thin film transistor with zero and determining a greater one of the sum and zero as a second turn-on voltage threshold; and generating the multiplexing unit gate signals which are greater than the second turn-on voltage threshold.

4. The method of claim 1, wherein the generating the multiplexing unit gate signals for the respective thin film transistors of the multiplexing unit based on the plurality of data signals comprises:

determining zero as a first turn-off voltage threshold in response to that the data signals are positive voltage signals; and generating the multiplexing unit gate signals which are smaller than the first turn-off voltage threshold.

5. The method of claim 1, wherein the generating the multiplexing unit gate signals for the respective thin film transistors of the multiplexing unit based on the plurality of data signals comprises:

in response to that the data signals are negative voltage signal, comparing a sum of the minimum negative voltage and a threshold voltage of the thin film transistor with zero and determining a smaller one of the sum and zero as a second turn-off voltage threshold; and generating the multiplexing unit gate signals which are smaller than the second turn-off voltage threshold.

6. The method of claim 1, wherein each pixel comprises a first primary-color sub-pixel, a second primary-color sub-pixel, and a third primary-color sub-pixel, and in the same frame, voltages of a plurality of data signals for driving a plurality of columns of sub-pixels with the same primary color have the same polarity.

7. A driving circuit of a display panel, wherein the display panel comprises a multiplexing unit and a plurality of pixels arranged in an array of M rows and N columns, the multiplexing unit comprises a plurality of thin film transistors, and each thin film transistor of the multiplexing unit comprises a gate electrode applied with a multiplexing unit gate signal, a first electrode applied with a data signal, and a second electrode electrically connected to a pixel driving circuit of a pixel; and wherein the driving circuit comprises:

an acquisition circuit configured to acquire a plurality of data signals for driving i-th row of pixels, where $1 \leq i \leq M$;

a generation circuit configured to generate multiplexing unit gate signals for respective thin film transistors of the multiplexing unit based on the plurality of data signals; and a comparison circuit, wherein the generation circuit is electrically connected to gate electrodes of the respective thin film transistors so as to apply the multiplexing unit gate signals to the gate electrodes of the respective thin film transistors, so that the respective thin film transistors of the multiplexing unit are turned on or turned off;

wherein the multiplexing unit gate signals change according to changes of the plurality of data signals; and wherein the comparison circuit is configured to:

determine a maximum positive voltage which has a maximum value among a plurality of positive voltage signals; and determine a minimum negative voltage which has a minimum absolute value among a plurality of negative voltage signals.

8. The driving circuit of claim 7, wherein the generation circuit is further configured to:

determine a sum of the maximum positive voltage and a threshold voltage of the thin film transistor as a first turn-on voltage threshold, in response to that the data signals are positive voltage signals; and generate the multiplexing unit gate signals which are greater than the first turn-on voltage threshold.

9. The driving circuit of claim 7, wherein the generation circuit is further configured to:

in response to that the data signals are negative voltage signals, compare a sum of the minimum negative voltage and a threshold voltage of the thin film transistor with zero and determine a greater one of the sum and zero as a second turn-on voltage threshold; and generate the multiplexing unit gate signals which are greater than the second turn-on voltage threshold.

10. The driving circuit of claim 7, wherein the generation circuit is further configured to:

determine zero as a first turn-off voltage threshold in response to that the data signals are positive voltage signals; and generate the multiplexing unit gate signals which are smaller than the first turn-off voltage threshold.

11. The driving circuit of claim 7, wherein the generation circuit is further configured to:

in response to that the data signals are negative voltage signal, compare a sum of the minimum negative voltage and a threshold voltage of the thin film transistor with zero and determine a smaller one of the sum and zero as a second turn-off voltage threshold; and generate the multiplexing unit gate signals which are smaller than the second turn-off voltage threshold.

12. A display panel comprising the driving circuit of claim 7.

* * * * *